United States Patent [19]

Malek

[11] Patent Number: 4,703,875

[45] Date of Patent: Nov. 3, 1987

[54] LOW MASS PISTON FOR AEROSOL CONTAINER

[75] Inventor: Edward J. Malek, Racine County, Wis.

[73] Assignee: S. C. Johnson & Son, Inc., Racine, Wis.

[21] Appl. No.: 889,567

[22] Filed: Jul. 24, 1986

[51] Int. Cl.[4] ..... F16J 1/04

[52] U.S. Cl. ..... 222/386.5; 222/389; 92/210; 92/239; 92/248

[58] Field of Search ..... 222/386, 386.5, 389, 222/326, 342, 394, 399, 405; 92/210, 239, 248

[56] References Cited

U.S. PATENT DOCUMENTS

| | | | |
|---|---|---|---|
| 3,066,836 | 12/1962 | Trumbull | 222/389 X |
| 3,099,370 | 7/1963 | Hein | 222/389 X |
| 3,132,570 | 5/1964 | Hoffman, Jr. et al. | 222/389 X |
| 3,245,591 | 4/1966 | Kneusel et al. | 222/389 |
| 3,381,863 | 5/1966 | Towns | 222/386.5 |
| 3,407,974 | 10/1968 | Chmielowiec | 222/389 X |
| 3,433,134 | 3/1969 | Vellekoop | 92/243 |
| 3,901,416 | 8/1975 | Schultz | 222/389 |
| 4,023,717 | 5/1977 | Schultz | 222/386.5 |
| 4,106,674 | 8/1978 | Schultz | 222/386.5 |
| 4,323,177 | 4/1982 | Nielsen | 222/386 |

FOREIGN PATENT DOCUMENTS

| | | | |
|---|---|---|---|
| 948641 | 2/1964 | United Kingdom | 222/389 |

*Primary Examiner*—Joseph J. Rolla
*Assistant Examiner*—Nils E. Pedersen

[57] ABSTRACT

An injection-molded piston for an aerosol container has a face portion for contacting and exerting pressure on material to be dispensed, and a thin, flexible skirt depending axially from and circumscribing the face portion for forming an effective seal against the inside wall of the container. The outer wall of the skirt is continuous, while the circumference of the inner wall has alternating areas of constant thickness along said areas and areas of minimum thickness, the curved portions forming with the outer wall a plurality of sections, the thickness and circumferential extent of each of which decrease axially along the skirt toward its distal end. The piston includes a depending extension on the skirt which aids sealing.

17 Claims, 4 Drawing Figures

Fig. 1.
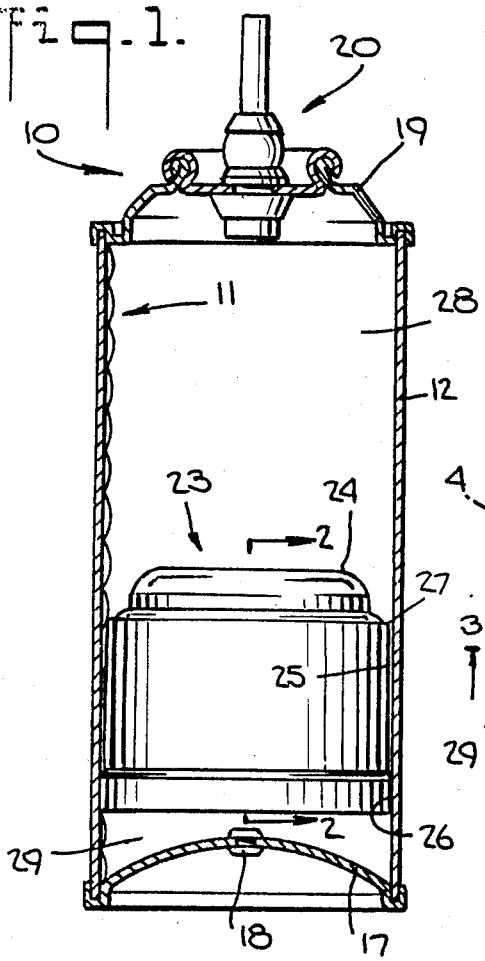
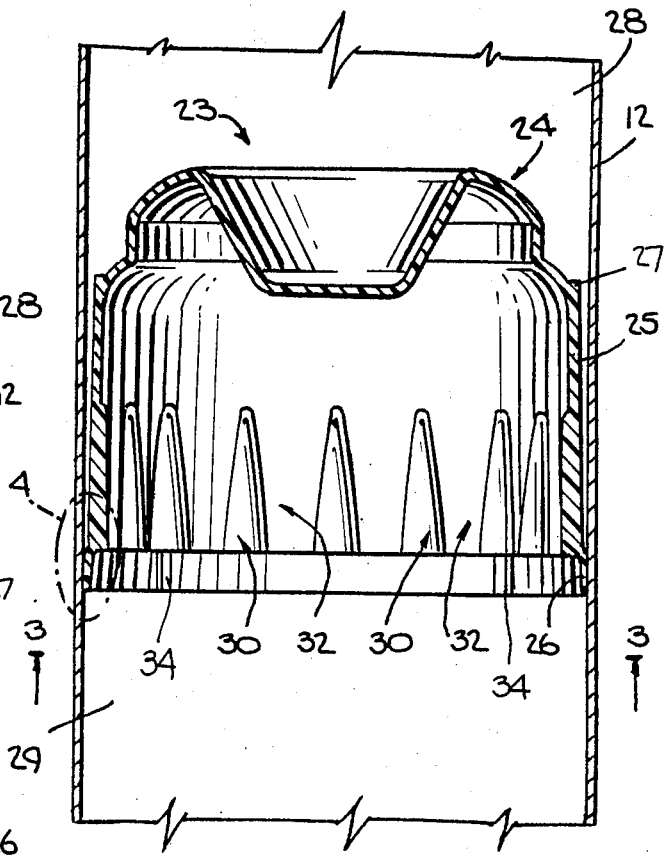
Fig. 2.
Fig. 4.
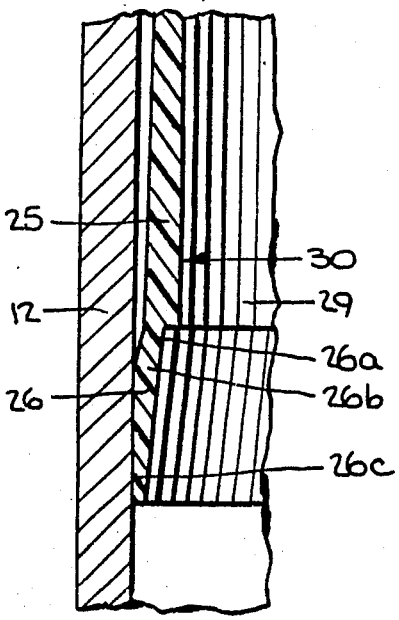
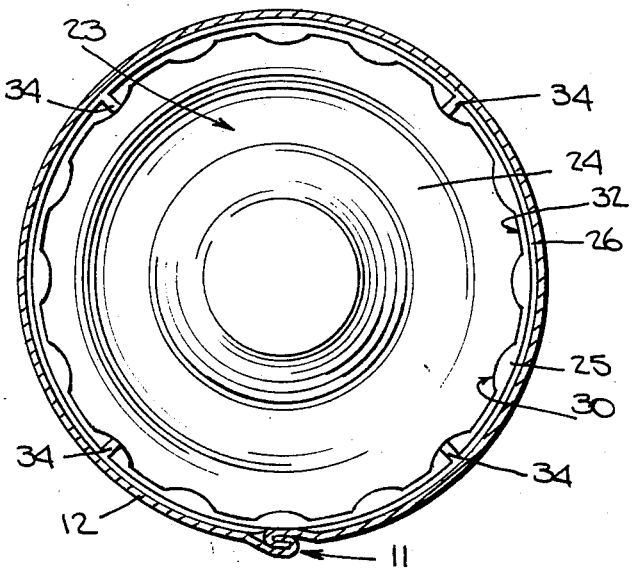
Fig. 3.

LOW MASS PISTON FOR AEROSOL CONTAINER

BACKGROUND OF THE INVENTION

1. Field of the Invention

The present invention relates to a piston and, more particularly, to a low mass piston adapted for use in pressurizing a material to be dispensed from an aerosol container.

2. Description of Related Art

Aerosol containers are used to dispense many materials, all of which, by definition, are held under pressure in the container. In some cases, a piston is disposed within the container, and the material to be dispensed is on one side of the piston and a pressurized fluid, typically air, is on the other side of the piston. As the material is dispensed, the piston maintains pressure on the remaining material by translating longitudinally within the container in contact with the inside wall of the container.

For proper operation, the piston must form and maintain an effective seal with the inside wall of the aerosol container. If the piston fails to seal, the material to be dispensed may leak to the pressurized fluid side of the piston. This leakage reduces the amount of material which can be dispensed. Moreover, for certain types of material and pressurized fluid, the leaked material may spoil. Additionally, when the piston-sidewall seal fails, the pressurized fluid may leak to the material side of the piston. This fault, known as blow by can also create problems.

Discontinuities in the inside wall of an aerosol container make it difficult to maintain an effective seal between the piston and the side wall. Discontinuities can be either consistent (e.g., a seam) or random (e.g., a dent). Such discontinuities can cause the seal to fail or the piston to bind or both. The likelihood of either seal failure or piston binding is dependent on both the longitudinal and radial rigidity of the piston. That is, a piston having a high radial rigidity is likely to leak or bind when it encounters a discontinuity. A piston having a high longitudinal rigidity is likely to bind when it encounters a discontinuity.

Many different piston designs have been proposed in attempts to provide an effective seal for an aerosol container, but the simplest, least expensive, and therefore most desirable design is a piston having a flexible skirt. Accordingly, a common piston configuration is a one-piece injection molded plastic piston having a face portion and a flexible skirt for sealingly engaging the inside wall of the aerosol container. The longitudinal and radial rigidity of the piston are generally determined by the length and the thickness of the plastic skirt.

Injection molding, however, inherently limits how thin the skirt can be made. If the skirt is made too thin, molten plastic will not consistently and evenly fill the mold. Pistons having longitudinal ridges for channeling the molten plastic into the thin skirt walls are known in the art (see, for example, U.S. Pat. No. 3,915,352), but such ridges materially increase the longitudinal rigidity of the skirt. Other patents also show pistons having ridges in the piston skirt (see, for example, U.S. Pat. No. 3,099,370 and U.S. Pat. No. 3,132,570), but all such ridges will materially increase the rigidity of the skirt.

SUMMARY OF THE INVENTION

It is therefore an object of the present invention to overcome the disadvantages of the prior art.

These objects and further advantages are achieved by the present invention, an important aspect of which is a piston comprising a flexible skirt for sealingly engaging the side walls of a container, which skirt depends axially from and circumscribes a face portion and has a substantially continuous arcuate outer wall and an inner wall including a plurality of axially-extending flat portions alternating circumferentially with a plurality of arcuate portions defining with the outer wall a plurality of sections, each having a thickness and circumferential extent that decreases axially along the skirt toward the distal end thereof.

These and other objects feature and advantages of the present invention will become apparent in view of the detailed description of preferred embodiments set forth below in conjunction with the drawings.

BRIEF DESCRIPTION OF THE DRAWINGS

FIG. 1 is a longitudinal cut-away view of a low mass piston in an aerosol container according to the present invention.

FIG. 2 is a vertical cross-sectional view taken along line 2—2 of FIG. 1, showing the interior geometry of a low mass piston according to the present invention.

FIG. 3 is a bottom view of the aerosol container taken along line 3—3 of FIG. 2.

FIG. 4 is an enlarged cross-sectional view of a portion of the distal end of the low mass piston shown in FIG. 2.

DETAILED DESCRIPTION OF PREFERRED EMBODIMENTS

Referring now the drawings, wherein like reference numerals designate like or corresponding parts throughout the several views, FIGS. 1 through 4 illustrate a preferred embodiment of the present invention.

A container 10 as shown in FIG. 1 is conventional and has a side seam 11 (see also FIG. 3). The container side wall 12 is an initially flat piece of sheet metal which has been bent into a cylindrical shape. The edges of the metal sheet are then crimped together by known means to form the seam 11, which may be soldered to make it fluid tight. Crimped to the bottom edge of the side wall 12 is a bottom wall 17 having a hole through which a pressurized fluid is introduced into the container, after which the hole is closed by a resilient plug 18. Crimped to the top edge of the side wall 12 is a top wall 19 having a large opening into which a valve assembly 20 is seated. The edge of the valve assembly 20 is crimped to the edge surrounding the opening in the top wall 19.

Slidable longitudinally within the container 10 is a hollow piston 23, preferably formed by injection molding any suitable plastic material, comprising an integral face portion 24, a flexible skirt 25 and a skirt extension 26. The face portion 24 is shaped generally to conform to the shape of the lower surface of the top wall 19 and the valve assembly 20 so that when the piston 23 reaches the top of the container 10 it will expel all or substantially all of the material in the container through the valve assembly 20. The region 28 within the container above the piston 23 is filled with the material to be dispensed, and the region 29 within and below the piston 23 is filled with a pressurized fluid, such as compressed air.

Referred now to FIGS. 2 and 3, a preferred embodiment of the piston 23 of the present invention is illustrated. The face portion 24 merges into the flexible skirt 25, such that the flexible skirt 25 depends axially from, and circumscribes, the face portion 24. The flexible skirt 25 terminates in the flexible extension 26, which axially depends from and circumscribes the flexible skirt 25.

The skirt 25 and extension 26 provide an effective seal with an aerosol container. The outer wall of the skirt 25 is smooth and continuous, having a generally circular cross-section with a slight constant outward taper toward the distal end of the skirt 25. This allows a small amount of the material in the container to lubricate the interface between the inside wall of the container 12 and the piston 23, to facilitate the translation of the piston 23. The inner wall of the flexible skirt is discontinuous, having alternating, equally spaced, areas of increased thickness 30 and areas of minimum thickness 32 therearound.

In the preferred embodiment, the areas of minimum thickness 32 of the inner wall are curved correspondingly to the curvature of the outer wall of the skirt, and thus are generally co-axial with the outer wall in the embodiment shown. The face portion 24 and the skirt 25 are integral, but for purposes of description they may be considered to join together at the axial location where the areas of increased thickness 30 begin (see FIG. 2). At that location, the skirt 25 for its entire periphery has the same thickness as the face portion 24. However, where the skirt 25 joins the face portion 24, the areas of minimum thickness 32 begin to decrease linearly in thickness axially toward the distal end of the skirt 25. Areas of increased thickness 30 remain at the same thickness at the centers of the areas for the axial extent of the skirt 25. Thus, the areas of minimum thickness 32 of the inner wall define with the outer wall a plurality of circumferentially equally spaced sections the thickness and circumferential extent of each of which decrease axially along the skirt toward the distal end thereof.

The alternating increased thickness areas 30 and areas of minimum thickness 32 configuration of the interior wall of the flexible flange 25 permits the production of an effective low mass piston not otherwise possible by injection molding. The areas of increased thickness 30 create channels for the molten plastic uniformly to traverse the entire axial length and the entire circumference of the thin walled flexible skirt 25, evenly distributing the molten plastic to fill completely both the thin walled skirt 25 and the extension 26. This configuration also gives the piston 23 longitudinal stability; however, unlike conventional ridged pistons, the areas of increased thickness 30 of the piston of the present invention do not materially alter the longitudinal and radial flexibility of the skirt 25 relative to the sections formed by the areas of minimum thickness 32. The interior wall of the flexible skirt 25 is therefore flexible enough to accommodate both consistent and random discontinuities (the side seam 11 and dents, respectively) in the container side wall without causing binding or seal failure. Typically, the areas of minimum thickness 32 will occupy about 15 to 50% of the circumferences of the distal end of flexible skirt 25. Areas of minimum thickness 32 will generally have a thickness of 0.008 to 0.015 inches while areas of increased thickness 30 will be 0.030 to 0.040 inches thick.

FIG. 4 is an enlarged cross-sectional view of a preferred embodiment of the extension 26. The inner and outer walls of the extension 26 are coaxial with the outer wall of the skirt 25 of the piston. The outer wall surface, for a predetermined length, flares radially outward from the skirt 25 to engage the inside of the container side wall 12, then forms a cylinder to its distal end. The cross-section configuration of the extension 26, with a thin portion 26*a* at its connection with the skirt, a thicker portion 26*b* where it flares outwardly and then a tapering portion 26*c* toward its distal end, provides the extension 26 with radial flexibility and allows the molten plastic to fill the mold to form the extension 26. The molten plastic easily gains access to the entire periphery of the extension 26 because of the flat portions 32, which enables the extension to be made extremely thin.

Referring again to FIG. 3, the piston 23 is shown in sealing engagement with the container side wall 12, having a consistent discontinuity (seam 11). Since the flexible skirt 25 and extension 26 have substantial radial flexibility, the piston forms an effective seal with the container side wall 12, even at the seam 11 or at dents (not shown).

As an example of a piston of the present invention made by an injection mold process, molten plastic is injected at the face portion 24 using known methods. In this embodiment, the face portion has an overall diameter of 1.72 inches and a typical wall thickness of 0.035 inches. The skirt has an overall length of about 1.305 inches, and flares linearly to an overall diameter of 2.036 inches. The thickness of the areas of minimum thickness 32 decreases linearly from a thickness of 0.035 inches where the skirt and the face portion join to a thickness of 0.020 inches at its distal end, while the thickness of each area of increased thickness 30, at its center line, remains at 0.035 inches. The extension 26 has an overall length of 0.180 inches and diameter of 1.996 inches. The wall thickness of the extension is 0.010 inches at the distal end.

The flexibility of the skirt 25 and the extension 26 in the piston according to the present invention provides an extremely effective seal both when the container is initially filled with the material to be dispensed and if the container diameter increases as a result of being pressurized. Moreover, the thinness of the walls of the skirt and the extension combat both leakage (either material blow-dry or secondary permeation) and binding of the piston as the product is dispensed. Such advantages would not be obtainable with a prior art piston that has ridges to enable the injection molded walls to be made thinner, since such ridges provide a substantial amount of longitudinal rigidity. Thus, if the container happened to be dented at the circumferential location where the piston has a ridge, leakage past the piston would be a distinct possibility. A piston according to the present invention overcomes this and other drawbacks of the prior art.

An additional optional embodiment includes a denesting feature. As shown in FIGS. 1 and 2, piston 23 can include a ridge 27 around the circumference of piston 23 where face portion 24 and skirt 25 join. As shown in FIGS. 2 and 3, a plurality of denesting lugs 34 are spaced around skirt extension 26. Lugs 34 have the same thickness as the center of the area of increased thickness 30. When pistons 23 are stacked, lugs 34 contact ridge 27 to prevent nesting.

Numerous modifications and variations of the present invention are possible in light of the above teachings. For example, although the distal end of the piston shown in the drawings lies in a plane, it would be possible to provide a scalloped bottom without departing from the spirit of the invention. It is therefore to be understood that, within the scope of the appended claims, the invention may be practiced otherwise than as specifically described herein.

What is claimed is:

1. A piston comprising a flexible skirt depending axially from and circumscribing a face portion, said skirt having a substantially continuous arcuate outer wall and an inner wall including a plurality of axially-extending areas of constant thickness along the length of said areas alternating circumferentially with a plurality of areas of minimum thickness defining with said outer wall a plurality of sections, each having a thickness and circumferential extent that decrease axially along said skirt toward the distal end thereof, said areas of minimum thickness being thinner than said areas of constant thickness.

2. A piston according to claim 1, wherein said outer wall is substantially circular in a plane normal to the axis of said skirt, said inner wall at said sections is substantially coaxial with said outer wall and said sections decrease in thickness linearly from said face portion to the distal end of said skirt.

3. A piston according to claim 2, wherein said sections are equally spaced circumferentially.

4. A piston according to claim 3, wherein said inner wall between said sections comprises areas of constant thickness along the length of said area, said areas increasing in width continuously from said face portion to the distal end of said skirt.

5. A piston according to claim 4, wherein said outer wall increases linearly in diameter axially along said skirt to the distal end thereof.

6. A piston according to claim 4, wherein said face portion and said skirt are integral, injection-molded parts, said skirt around its periphery is substantially the same thickness as said face portion where said face portion and said skirt join together and the thickness of said skirt is substantially constant axially at the center of said areas of constant thickness.

7. A piston according to claim 2, further comprising an extension circumscribing said skirt at the distal end thereof.

8. A piston according to claim 7, wherein the inner and outer walls of said extension are circular and substantially coaxial with said outer wall of said skirt and the thickness of said extension at the distal end thereof is less than the thickness of said sections of said skirt at the distal end thereof.

9. A piston according to claim 8, wherein said face portion, said skirt and said extension are integral, injection-molded parts, said outer wall of said skirt increases linearly in diameter axially along said skirt toward the distal end thereof and said extension has a generally cylindrical outer wall with a larger diameter than said outer wall of said skirt at the distal end thereof.

10. A piston according to claim 9, wherein said extension includes a first axial portion where said extension and said skirt join together, a second axial porton having a thickness greater than said first axial portion and a third axial portion tapering in thickness axially from said second axial portion toward the distal end of said extension.

11. A container for dispensing material, comprising:

a container body for holding the material; and a piston in said container body for exerting pressure on the material, said piston including a face portion for contacting the material and a flexible skirt depending axially from and circumscribing said face portion, said skirt having a substantially continuous arcuate outer wall for sealingly engaging the inside wall of said container body and an inner wall including a plurality of areas of constant thickness along the length of said areas alternating circumferentially with a plurality of areas of minimum thickness defining with said outer wall a plurality of sections, each having a thickness and circumferential extent that decrease axially along said skirt toward the distal end thereof, said areas of minimum thickness being thinner than said areas of constant thickness.

12. A container according to claim 11, wherein said piston is injection-molded with said face portion and said skirt integral with each other.

13. A container according to claim 12, wherein said container body includes a side seam.

14. A container according to claim 13, wherein said container has a compressed fluid on the skirt side of said piston and the material on the other side of said piston, wherein said compressed fluid causes said piston to exert pressure axially on the material.

15. A container according to claim 14, wherein said piston further includes an extension circumscribing said skirt at the distal end thereof.

16. A container according to claim 15, wherein said container body and said piston are circular in cross-section and the distal end of said extension lines in a plane substantially normal to the cross-section of said container body.

17. A container according to claim 14, wherein said container body includes a valve secured to one end thereof, said piston is disposed in said container body with the skirt side of said piston directed away from said one end of said container body and said face portion has a contour generally corresponding to the contour of said one end of said container body.

* * * * *

UNITED STATES PATENT AND TRADEMARK OFFICE

CERTIFICATE OF CORRECTION

PATENT NO. : 4,703,875

DATED : November 3, 1987

INVENTOR(S) : Edward J. Malek

It is certified that error appears in the above-identified patent and that said Letters Patent is hereby corrected as shown below:

In Column 6, Line 44, the word "lines" should read, --lies--.

Signed and Sealed this

Twenty-seventh Day of September, 1988

*Attest:*

DONALD J. QUIGG

*Attesting Officer*

*Commissioner of Patents and Trademarks*